United States Patent [19]

Hattler et al.

[11] 3,941,085

[45] Mar. 2, 1976

[54] RELEASE MATERIAL APPLICATOR

[75] Inventors: Louis R. Hattler, Marion; Ari Bar-on, Rochester, both of N.Y.

[73] Assignee: Xerox Corporation, Stamford, Conn.

[22] Filed: Feb. 19, 1975

[21] Appl. No.: 551,214

[52] U.S. Cl. ..... 118/60; 118/76; 118/271; 427/22; 432/60; 432/75

[51] Int. Cl.[2] ..... G03G 15/20

[58] Field of Search ..... 118/60, 200, 76, 271; 432/60, 228, 75; 427/22

[56] References Cited

UNITED STATES PATENTS

| | | | |
|---|---|---|---|
| 3,142,241 | 7/1964 | Limberger | 118/271 |
| 3,156,632 | 11/1964 | Chessin et al. | 118/76 |
| 3,438,354 | 4/1969 | Luescher | 118/76 |
| 3,454,137 | 7/1969 | Aygun et al. | 118/76 |
| 3,810,776 | 5/1974 | Banks et al. | 432/60 |

*Primary Examiner*—Mervin Stein
*Assistant Examiner*—Douglas Salser
*Attorney, Agent, or Firm*—H. Fleischer; J. J. Ralabate; C. A. Green

[57] ABSTRACT

An apparatus in which release material is applied to a heated fuser member. A back up member is in communication with the fuser member and a sheet of support material having particles thereon passes therebetween. The particles on the sheet of support material contact the fuser member. The apparatus reciprocates a bar of release material into and out of contact with the fuser member.

The foregoing abstract is neither intended to define the invention disclosed in the specification, nor is it intended to be limiting as to the scope of the invention in any way.

10 Claims, 2 Drawing Figures

RELEASE MATERIAL APPLICATOR

BACKGROUND OF THE INVENTION

This invention relates generally to a fusing apparatus employed in an electrostatographic printing machine, and more particularly concerns an apparatus for applying release material to a heated fuser member employed therein.

In the process of electrostatographic printing, a latent image is recorded on a surface and rendered visible with particles. These particles are transferred to a sheet of support material in image configuration. Thereafter, the particles are permanently affixed to the sheet of support material forming a copy of the original document thereon. Electrostatographic printing includes electrophotographic printing and electrographic printing. Electrophotographic printing employs a photoconductive member which is charged to substantially uniform level. A light image of an original document dissipates the charged photoconductive member recording a latent image of the original document thereon. Electrographic printing does not utilize a photoconductive member or a light image to create a latent image of the original document. However, in both of the foregoing processes, heat settable particles are generally employed to develop the latent image. After the particles are transferred to a sheet of support material, heat is applied thereto so as to permanently affix them to the sheet of support material.

Numerous techniques have been devised for applying heat to the particles transferred to the sheet of support material. One approach passes the sheet of support material, with the particles thereon, between a pair of opposed rollers. Frequently, the outer surface of the heated fuser roller is covered with polytetrafluoroethylene, commonly known as Teflon, to which a release agent such as silicone is applied. This Teflon layer may, preferably, have a thickness of several mils. The layer of oil applied thereto generally has a thickness of less than 1 micron. Silicone based oil possesses a relatively low surface energy and is particularly advantageous for use with Teflon. A thin layer of this oil is applied to the surface of the heated roller forming an interface between the roll surface and powder image on the sheet of support material. The low surface energy of this layer prevents the particles from transferring to the roller rather than remaining adhered to the sheet of support material. Thus, the particles are permanently affixed to the sheet of support material and do not smear or transfer to the roller.

Rather than employing a roller having a Teflon outer covering, a bare or heated metal roller may be utilized. When such a roller is employed, a low molecular weight polyethylene is applied thereto as a release agent. This release agent is generally a solid at room temperature. Prior techniques have maintained the release agent in its sump adjacent to the heated roller. As the fuser roller reaches the operating temperature, the release agent melts. However, it has been found that the life expectancy of polyethylene release material is greater in the solid state than in the liquid state. Thus, various techniques have been developed for articulating the release material as a solid bar so as to move it into and out of contact with the heated fuser roller. An example of such an approach is found in copending application Ser. No. 540,731 filed in 1975.

It is the primary object of the present invention to improve the apparatus employed to articulate a solid release material into and out of contact with a heated fuser member.

SUMMARY OF THE INVENTION

Briefly stated, and in accordance with the present invention, there is provided an apparatus for applying a release material to a heated fuser member in communication with a back up member. A sheet of support material having particles thereon passes between the fuser member and back up member. The sheet of support material is positioned such that the particles thereon contact the fuser member.

Pursuant to the features of the present invention, a bar of release material is mounted movably in the frame. Means resiliently urge the bar of release material to a first position spaced from the fuser member. A solenoid, operatively associated with the bar of release material, moves the bar of release material from the first position spaced from the fuser member to a second position in contact therewith. When the solenoid is de-energized, the bar of release material is resiliently urged to return to its first position.

BRIEF DESCRIPTION OF THE DRAWINGS

Other objects and advantages of the present invention will become apparent upon reading the following detailed description and upon reference to the drawings, in which.

While the present invention will hereinafter be described in connection with various embodiments thereof, it will be understood that it will not be intended to limit the invention to those embodiments. On the contrary, it is intended to cover all alternatives, modifications and equivalents as may be included within the spirit and scope of the invention as defined by the appended claims.

DETAILED DESCRIPTION

Figure 1:
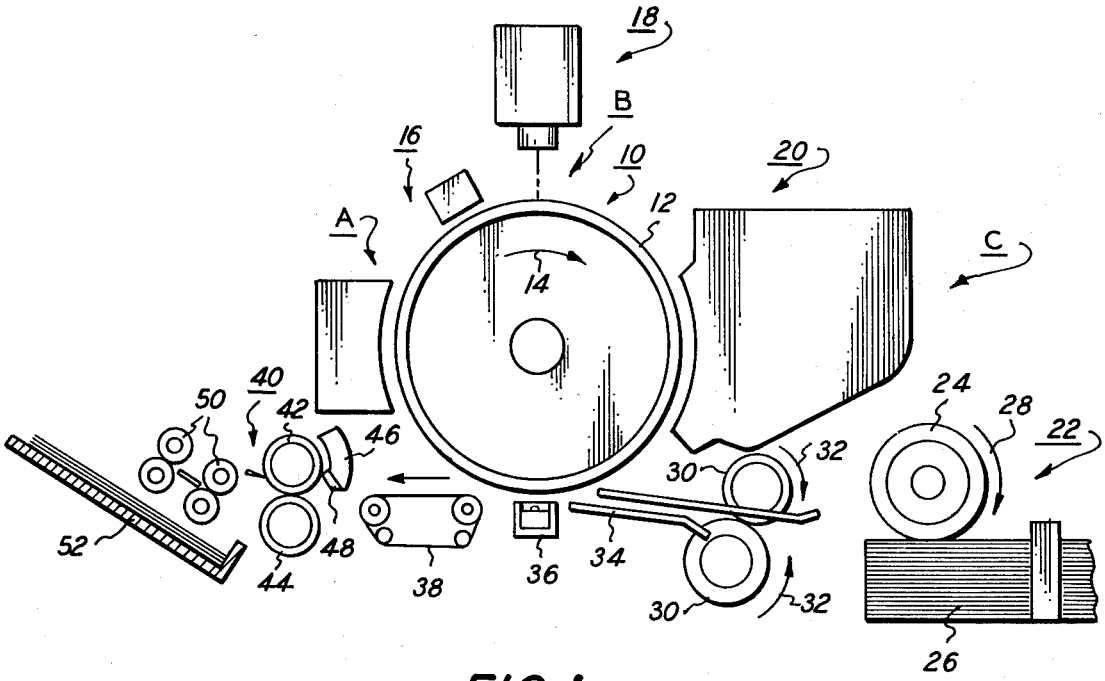
FIG. 1 is a schematic elevational view illustrating an electrophotographic printing machine having a fusing apparatus incorporating the features of the present invention therein.

An electrophotographic printing machine is shown in FIG. 1 having the features of the present invention therein. In the drawings, like reference numerals have been employed throughout to designate like elements. The apparatus of the present invention applies release material to a heated fuser roller employed in a fusing apparatus. Though this apparatus is particularly well adapted for use in a fusing apparatus, it should be evident from the following discussion that it is equally well suited for use in a wide variety of devices and is not necessarily limited in its application to the particular embodiment shown herein.

The art of electrophotographic printing is well known. As such, the various processing stations employed in the printing machine of FIG. 1 will be shown as blocks designated by the reference letters A through F, inclusive.

The electrophotographic printing machine of FIG. 1 employs a drum 10 having a photoconductive surface 12 entrained about and secured to the exterior circumferential surface thereof. As drum 10 rotates in the direction of arrow 14, it passes through the various processing stations disposed about the periphery thereof. One type of suitable photoconductive material is described in U.S. Pat. No. 2,970,906 issued to Bixby in 1961. As disclosed therein, photoconductive surface 12 may be made from a suitable selenium alloy.

Drum 10 initially rotates photoconductive surface 12 through charging station A. Charging station A has a corona generating device, indicated generally by the reference numeral 16, positioned closely adjacent to photoconductive surface 12. Corona generating device 16 charges photoconductive surface 12 to a relatively high substantially uniform potential. A suitable corona generating device is described in U.S. Pat. No. 2,836,725 issued to Vyverberg in 1958.

Thereafter, the charged portion of photoconductive surface 12 rotates through exposure station B. Exposure station B includes an exposure mechanism, indicated generally by the reference numeral 18, having a stationary housing for supporting an original document thereon. The housing comprises a transparent platen upon which the original document is positioned. Lamps illuminate the original document. Scanning of the original document is achieved by oscillating a mirror in a timed relationship with the movement of drum 10, or in lieu thereof, by moving the lamps and lens system so as to form a flowing light image. The light image of the original document is reflected through the lens onto a mirror which, in turn, transmits the light image through a slit onto the charged portion of photoconductive surface 12. Irradiation of photoconductive surface 12 selectively dissipates the charge thereon recording an electrostatic latent image corresponding to the original document.

The electrostatic latent image recorded on photoconductive surface 12 is next rotated to development station C. At development station C, a developer unit 20 having a housing with the supply of developer mix contained therein renders the electrostatic latent image visible. The developer mix generally comprises carrier granules having toner particles adhering thereto. These carrier granules are formed from a magnetic material while the toner particles are usually a heat settable plastic. Preferably, developer unit 20 is a magnetic brush development system. In such a system, the developer mix is brought through a directional flux field forming a brush thereof. The brush of developer mix contacts the electrostatic latent image recorded on photoconductive surface 12. The latent image attracts electrostatically the toner particles from the carrier granules so as to form a toner powder image on photoconductive surface 12.

Prior to continuing with the remaining processing stations, the sheet feeding path will be briefly described. With continued reference to FIG. 1, a sheet of support material is advanced by sheet feeding apparatus 22 to transfer station D. Sheet feeding apparatus 22 includes a feed roller 24 contacting the upper most sheet of a stack of sheets of support material 26. Feed roller 24 rotates in the direction of arrow 28 advancing successive uppermost sheets from stack 26 into register roll 30. Register roll 30, rotating in the direction of arrow 32, aligns and forwards the advancing sheet of support material into chute 34. Chute 34 directs the advancing sheet of support material into contact with photoconductive surface 12, in registration with the toner powder image deposited thereon. In this manner, the sheet of support material is moved into contact with the toner powder image on photoconductive surface 12 at transfer station D.

Transfer station D includes a corona generating device 36. Corona generating device 36 applies a spray of ions onto the side of the sheet of support material opposed from photoconductive surface 12. The toner powder image adhering to photoconductive surface 12 is then attracted therefrom to the surface of the sheet of support material in contact therewith. After transferring the toner powder image to the sheet of support material, endless belt conveyor 38 advances the sheet of support material to fixing station E.

Fixing station E includes a fuser assembly, indicated generally by the reference numeral 40. Fuser assembly 40 heats the transferred toner powder image to permanently affixing it to the sheet of support material. Fuser assembly 40 includes a heated fuser member or roll, shown generally at 42, and a back up member or roll, indicated generally by the reference numeral 44. The sheet of support material with the toner powder image thereon is interposed between fuser roll 42 and back up roll 44 with the toner powder image contacting fuser roll 42. Release material applicator 46 periodically applies release material to fuser roll 42. Blade 48 adjusts the thickness of the release material layer coating fuser roll 42. The detailed structure of the fusing apparatus and release material applicator will be described hereinafter, in greater detail, with reference to FIG. 2. After the toner powder image is permanently affixed to the sheet of support material, the sheet of support material is advanced by a series of rolls 50 to catch tray 52 for subsequent removal therefrom by the machine operator.

Invariably, residual toner particles adhere to photoconductive surface 12 after the transfer of the powder image to the sheet of support material. These resiual toner particles are removed from photoconductive surface 12 at cleaning station F. Cleaning station F includes a cleaning mechanism, generally designated by the reference numeral 54. Cleaning mechanism 54 includes a corona generating device and a brush in contact with photoconductive surface 12. Initially, toner particles are brought under the influence of the corona generating device to neutralize the electrostatic charge remaining on photoconductive surface 12 and the residual toner particles. Thereafter, the neutralized toner particles are removed from photoconductive surface 12 by the rotatably mounted fibrous brush in contact therewith. Subsequent to cleaning a discharge lamp floods photoconductive surface 12 with light to dissipate any residual charge remaining thereon. In this manner, the charge on photoconductive surface 12 is returned to the initial level prior to the recharging of photoconductive surface 12 of station A for the next successive imaging cycle.

It is believed that the foregoing description is sufficient for purposes of the present application to illustrate the general operation of an electrophotographic printing machine embodying the features of the present invention therein. Referring now to the specific subject matter of the present invention, FIG. 2 depicts the apparatus for applying release material to the heated fuser roller of the fusing apparatus.

Fuser assembly 40 includes a heated fuser roller, indicated generally by the reference numeral 42, and a back up roller, indicated generally by the reference numeral 44. Fuser roller 42 cooperates with back up roller 44 to define a nip through which the sheet of support material having the toner powder image thereon passes. The sheet of support material is orientated so that the toner powder image thereon contacts fuser roll 42. A channel shaped base (now shown) is provided for supporting fuser assembly 40 in the electrophotographic printing machine shown in FIG. 1. Back up roll 44 is mounted rotatably on a pair of brackets secured to the channel shaped base by means of a right angle bracket. Back up roll 44 rotates in the direction of arrow 56. Preferably, back up roll 44 includes a rigid steel core or shaft 58 having a Viton elastomeric surface or layer 60 disposed thereover and affixed thereto. Shaft 58 is secured rotatably on brackets by a pair of bearings secured thereto by retaining rings. By way of example, back up roll 44 has an overall dimension of approximately 1.55 inches with a 0.1 inch thick layer of Viton or other suitable high temperature elastomeric material. Other suitable materials are, for example, fluorosilicone or silicone rubber. Back up roll 44 is preferably 15 ½ inches long to accommodate various widths of support material.

A pair of brackets (not shown) having a generally E-shaped configuration are provided for mounting fuser roll 42 rotatably in fuser assembly 40. To this end, a pair of ball bearings one mounted in each of the support brackets provides a rotatable support. The bearings are retained in the brackets by means of retaining rings. A pair of end caps are secured to a hollow cylinder or core 62 forming a part of fuser roll 42. The end caps have reduced portions so as to be mounted in the bearings permitting fuser roll 42 to rotate in the direction of arrow 64. A heating element 66 is supported internally of cylinder 62 providing thermal energy to cylinder 62 heating it to the operating temperatures thereof. Heating element 66 develops sufficient heat to elevate the surface temperature of cylinder 62 to the operational temperature thereof, i.e. 285° to 295°F. By way of example, heating element 66 may include a quartz envelope having a tungsten resistance heating element disposed therein. Preferably, cylinder 62 is fabricated from any suitable material capable of efficiently conducting heat to the external surface thereof. For example, suitable materials are aluminum and alloys thereof, steel, stainless steel, nickel and nickel alloys thereof, nickel plated copper, chromium plated copper, and alloys thereof. The resultant fuser roll 42 has a diameter of preferably about 1.5 inches with the length thereof being about equal to that of back up roll 44. Fuser roll 42 requires about 420 watts peak power with the average power being about 320 watts, and about 100 watts being required for standby operation. Heating element 66 is supported internally of cylinder 62 by a pair of spring supports mounted in an insulated block secured to support brackets. The free ends of the spring supporting the heating elements are provided with the locating ball while the opposite end of the spring contacts an electrical terminal to which electrical wires may be attached for applying electrical energy to heating element 66. The insulating blocks may be secured to support brackets in a suitable manner, as for example, by means of screws. The spring supports and terminals are, preferably, rivoted to the insulating block. The material from which cylinder 62 is fabricated generally has a relatively high surface energy. Toner material in contact therewith readily wets the surface thereof. Toner wetting the surface of cylinder 62 is difficult to remove. Accordingly, there is provided apparatus 46 for applying release material thereto. The material is, preferably, a low molecular weight substance which is a solid at room temperature and has a relatively low viscosity at the operating temperature of cylinder 62. An example of such a material is polyethylene manufactured by Allied Chemical Company and having a designation AC-8 homopolymer. A bar of polyethylene is employed in the apparatus for applying release material to fuser roll 42.

Figure 2:
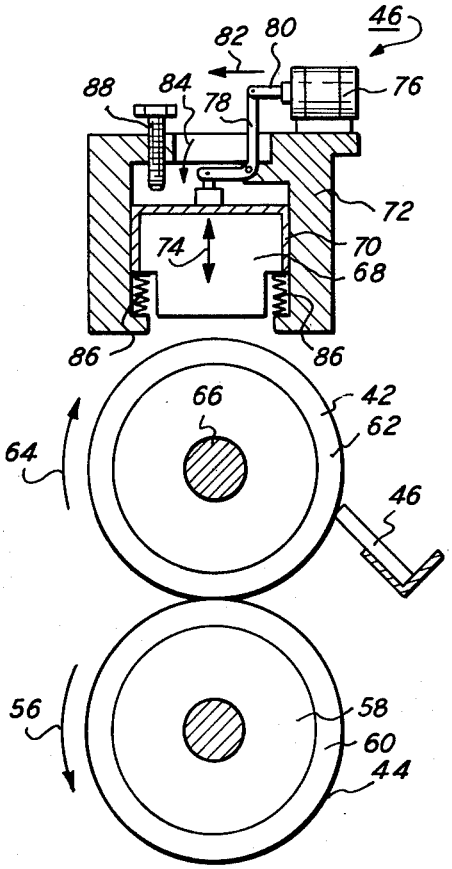
FIG. 2 is a schematic elevational view showing an apparatus for applying release material in the FIG. 1 printing machine fuser.

As shown in FIG. 2, a solid bar of polyethylene 68 is mounted in an open ended housing 70. Housing 70 reciprocates in frame 72 in the direction of arrow 74. More particularly, housing 70 is mounted slideably in frame 72. Solenoid 76 is coupled to housing 70 through the pivot arm 78. Energization of solenoid 76 moves arm 80 thereof in the direction of arrow 82. This pivots arm 78 in the direction of arrow 84, moving housing 70 in a downwardly direction thereby compressing springs 86. Polyethylene bar 68 moves in a downwardly direction thereby compressing spring 86. However, in the extreme downward position, polyethylene bar 68 contacts fuser roll 42 applying release material thereto. After polyethylene bar 68 has been in contact with fuser roll 42 a suitable duration of time, solenoid 76 is de-energized and springs 86, which have previously been compressed, move housing 70 and polyethylene bar 68 in an upwardly direction until housing 70 engages stop 88. Stop 88 is a bolt in threaded engagement with a portion of stationary frame 72. Rotation of stop 88 moves it in an upwardly or downwardly direction adjusting the location of the polyethylene bar in its spaced position from fuser roller 42. It should be noted that one portion of spring 86 is secured to stationary frame 72 while the other portion thereof is secured to movable housing 70. It is evident that energization of solenoid 76 advances the polyethylene bar 68 from a first position spaced from fuser roll 42 to a second position in contact therewith. De-energization of solenoid 76 permits springs 86 to resiliently urge the polyethylene bar 68 in an upwardly direction until housing 70 contacts stop 88. In this manner, polyethylene bar 68 is returned to its first position spaced from fuser roll 42. Polyethylene bar 68 articulates in the direction of arrow 74 depending upon the energization cycle of solenoid 76. Machine logic controls the energization cycle of solenoid 76 and it may be energized as many times per machine cycle as is required. Energization of solenoid 76 is achieved by a timing disc mounted on the shaft of drum 10. By way of example, the timing disc may be an opaque disc having a plurality of slits in the periphery thereof. A light source is mounted on one side of the disc with a photosensor being located on the other side thereof. As the slits therein pass through the light beam, the light rays are detected by the photosensor and a signal therefrom is processed by the machine logic. In this way, a suitable timing signal may be developed which is utilized to energize solenoid 76. By way of example, polyethylene bar 68 may be articulated at about 2 revolutions per minute, thereby moving polyethylene bar 68 into and out of contact with fuser roll 42 2 times per minute.

Blade 46 adjusts the thickness of the release material layer coating fuser roll 42 so as to maintain a prescribed thickness thereof. The detailed structure of the configuration of blade 46 is described in copending application Ser. No. 540,732, the disclosure of which is hereby incorporated into the present application.

In recapitulation, it is apparent that pursuant to the features of the present invention, as heretofore described, the apparatus of the present invention applies release material to a fuser roll. A solid bar of polyethylene material is reciprocated into and out of contact with a heated fuser roll. The thickness of the release material layer is regulated by a blade in contact therewith. This type of system insures that a prescribed amount of release material is applied to the fuser roll. In addition, the release material remains in a solid state extending the life thereof.

It is, therefore, evident that there has been provided, in accordance with the present invention, an apparatus for applying periodically release material to a fuser roll employed in the fusing apparatus of an electrophotographic printing machine. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for applying release material to a heated fuser member in communication with a back-up member wherein a sheet of support material having particles thereon passes therebetween with the particles contacting the fuser member, including:

a frame;

a bar of release material mounted movably in said frame;

means for resiliently urging said bar to a first position spaced from the fuser member;

a solenoid operatively associated with said bar; and means for periodically energizing said solenoid to move said bar from the first position spaced from the fuser member to a second position in contact with the fuser member, said resilient means returning said bar to the first position upon the energization of said solenoid.

2. An apparatus as recited in claim 1, further including a blade member contacting the fuser member to regulate the thickness of the layer of release material applied thereto.

3. An apparatus as recited in claim 2, wherein said resilient means includes a spring member arranged to be compressed as said bar member moves from the first position to the second position so as to exert a force on said bar which restores said bar to the first position with said solenoid being de-energized.

4. An apparatus as recited in claim 3, further including an adjustable member arranged to regulate the space between said bar and the fuser member in the first position.

5. An apparatus as recited in claim 4, wherein said bar of release material is a solid bar of polyethylene material.

6. A fusing apparatus employed in an electrostatographic printing machine for permanently affixing toner particles to a sheet of support material, including:

a heated fuser roll;

a back-up roll in communication with said fuser roll such that the sheet of support material passes therebetween with the toner particles contacting said fuser roll;

a frame;

a bar of release material mounted movably in said frame;

means for resiliently urging said bar to a first position spaced from said fuser roll;

a solenoid operatively associated with said bar; and means for periodically energizing said solenoid to move said bar from the first position spaced from said fuser roll to a second position in contact with said fuser roll, said resilient means returning said bar to the first position upon de-energization of said solenoid.

7. An apparatus as recited in claim 6, further including a blade member contacting said fuser roll to regulate the thickness of the layer of release material applied thereto.

8. An apparatus as recited in claim 7, wherein said resilient means includes a spring member arranged to be compressed as said bar moves from the first position to the second position so as to exert a force on said bar which restores said bar to the first position with said solenoid being de-energized.

9. An apparatus as recited in claim 8, further including an adjustable member arranged to regulate the space between said bar and said fuser roll in the first position.

10. An apparatus as recited in claim 9, wherein said bar or release material is a solid bar of polyethylene material.

* * * * *